US009902582B2

(12) United States Patent
Jang et al.

(10) Patent No.: US 9,902,582 B2
(45) Date of Patent: Feb. 27, 2018

(54) APPARATUS AND METHOD FOR CONTROLLING A BANKNOTE FEED RATE

(71) Applicants: Cheolwoong Jang, Seoul (KR); Sang Hwan Jang, Seoul (KR)

(72) Inventors: Cheolwoong Jang, Seoul (KR); Sang Hwan Jang, Seoul (KR)

(73) Assignee: Kisan Electronics Co., Ltd., Seoul (KR)

( * ) Notice: Subject to any disclaimer, the term of this patent is extended or adjusted under 35 U.S.C. 154(b) by 0 days.

(21) Appl. No.: 15/238,569

(22) Filed: Aug. 16, 2016

(65) Prior Publication Data

US 2017/0190529 A1 Jul. 6, 2017

(30) Foreign Application Priority Data

Aug. 17, 2015 (KR) ..... 10-2015-0115613

(51) Int. Cl.
*B65H 7/02* (2006.01)

(52) U.S. Cl.
CPC ..... *B65H 7/02* (2013.01); *B65H 2513/10* (2013.01); *B65H 2701/1912* (2013.01)

(58) Field of Classification Search
CPC ..... B65H 7/02; B65H 2513/10; B65H 2701/1912
See application file for complete search history.

(56) References Cited

U.S. PATENT DOCUMENTS

| | | | |
|---|---|---|---|
| 4,607,832 | A | 8/1986 | Abe |
| 5,541,393 | A | 7/1996 | Ikezawa et al. |
| 7,628,399 | B2 | 12/2009 | Dopfer |
| 8,052,145 | B2 | 11/2011 | Skinner et al. |
| 8,087,661 | B2 | 1/2012 | Iwami et al. |
| 2010/0090393 | A1 | 4/2010 | Ito et al. |

FOREIGN PATENT DOCUMENTS

| | | | |
|---|---|---|---|
| IN | 1853CHENP2013 | | 3/2016 |
| JP | 09319918 | A | 12/1997 |
| JP | 201253675 | A | 3/2012 |

OTHER PUBLICATIONS

Nahata Kenji; "Paper Sheet Processor"; Abstract of JP2012-53675A; Publication Date: Mar. 15, 2012; https://www4.j-platpat.inpit.go.

Sumikawa Takeshi et al; "Paper Money Discriminating Method"; Abstract of JP09319918A; Publication Date: Dec. 12, 1997; https://www4.j-platpat.inpit.go.

*Primary Examiner* — David H Bollinger
(74) *Attorney, Agent, or Firm* — Andrew D. Fortney; Central California IP Group, P.C.

(57) ABSTRACT

An apparatus and method for controlling and/or maintaining a banknote feed rate are disclosed. The apparatus includes a motor configured to generate a driving force to feed or transfer a banknote, a banknote sensing unit configured to detect fed or transferred banknotes, and a controller configured to calculate a feed rate of the fed or transferred banknotes by analyzing a banknote sensing signal from the banknote sensing unit, and control the motor based on the calculated feed rate.

20 Claims, 8 Drawing Sheets

APPARATUS AND METHOD FOR CONTROLLING A BANKNOTE FEED RATE

This application claims the benefit of Korean Patent Application No. 10-2015-0115613, filed on Aug. 17, 2015, which is hereby incorporated by reference as if fully set forth herein.

BACKGROUND OF THE INVENTION

Field of the Invention

The present disclosure relates to an apparatus and method for controlling the feed rate of banknotes, and more particularly, to an apparatus and method for controlling or maintaining an actual banknote feed rate of a banknote discriminator at a target feed rate based on an interval between transferring banknotes (e.g., in the banknote discriminator).

Discussion of the Related Art

In general, a banknote discriminator determines whether a banknote introduced therein is authentic or fit for circulation. For example, the banknote discriminator determines whether a banknote is fit (e.g., new, worn, or damaged) or counterfeit. The term "banknote discriminator" as used herein covers any banknote processing apparatus capable of (i) counting and/or determining fitness of bills and (ii) detecting counterfeit bills.

Banknote discriminators are used in places dealing with banknotes in large quantity and/or high frequency, such as banks, Cash-In-Transit (CIT) companies, currency exchanges, post offices, casinos, large stores, and convenience stores. Banknote discriminators can be used to process paper sheets, banknotes, checks, promissory notes, securities, valuable documents, gift certificates, coupons, tickets, marks, identifications, and the like in the present disclosure.

A conventional banknote discriminator maintains the revolution rate of a motor at a predetermined target revolution rate using an encoder at a shaft of the motor (e.g., a feed motor or a transfer motor) in order to maintain a banknote feed rate (e.g., the rate at which banknotes are transferred along a transfer path from a feeder to a decider) at a predetermined target feed rate.

However, even though the revolution rate of the motor is maintained at the predetermined target revolution rate (e.g., 1,000 rpm), the banknote feed rate may not in fact be at the predetermined target feed rate, due to slippage or delay of the banknotes which are fed through the banknote discriminator.

The background art is disclosed in Korea Registered Patent No. 10-0555828 (entitled "Apparatus and Method for Position Controlling of Pick-Up Roller in Media Dispenser" and registered on Feb. 21, 2006).

SUMMARY OF THE INVENTION

According to an aspect of the present invention, an apparatus and method are provided for controlling a banknote feed rate that substantially obviate one or more problems due to limitations and disadvantages of the related art.

An aspect of the present invention provides an apparatus and method for controlling and/or maintaining a banknote feed rate of a banknote discriminator at a predetermined target feed rate (e.g., a target banknote feed rate) based on an interval between banknotes or banknote transfers.

Another aspect of the present invention provides an apparatus and method for controlling and/or maintaining a banknote feed rate (e.g., an actual banknote feed rate) of a banknote discriminator at a predetermined target feed rate by measuring an actual feed rate of introduced banknotes and controlling a revolution rate of a motor based on the actual feed rate.

Other aspects, advantages, and salient features of the disclosure will be set forth in part in the description which follows and in part will become apparent to those skilled in the art upon examination of the following or may be learned from practice of the disclosure. The objectives and other advantages of the disclosure may be realized and attained by the structure(s) particularly pointed out in the written description and claims hereof as well as the appended drawings.

To achieve these objects and other advantages and in accordance with the purpose(s) of the disclosure, as embodied and broadly described herein, an apparatus for controlling and/or maintaining a banknote feed rate includes a motor configured to generate a driving force to feed or transfer a banknote, a banknote sensing unit configured to detect fed or transferred banknotes, and a controller configured to calculate a feed rate of the fed or transferred banknotes by analyzing a banknote sensing signal from the banknote sensing unit, and control the motor based on the calculated feed rate.

In another aspect of the present invention, a method for controlling and/or maintaining a banknote feed rate includes detecting an introduced banknote using a banknote sensing unit, calculating a banknote feed rate of the introduced banknote by analyzing a banknote sensing signal from the banknote sensing unit using a controller, and, using the controller, controlling a driving motor configured to feed or transfer banknotes based on the calculated feed rate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Figure 1:
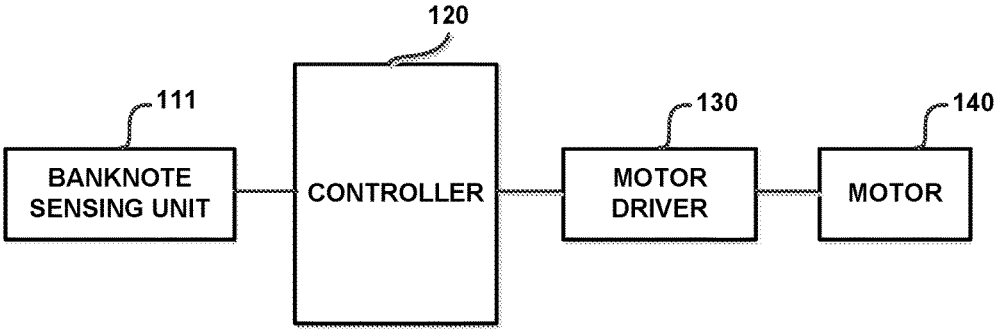
FIG. 1 is a block diagram of an exemplary apparatus for controlling and/or maintaining a banknote feed rate according to one or more embodiments of the present invention.

Embodiments of an apparatus and method for controlling and/or maintaining a banknote feed rate according to the present invention will be described below with reference to the attached drawings.

The thicknesses of lines or the sizes of components may be exaggerated in the drawings, for clarity and convenience of description. Further, the terms as set forth herein are defined in consideration of functions, operations, characteristics, etc. in the present invention, and they may be different according to the intent of an operator or the custom(s) in the art. Accordingly, the terms should be defined based on the overall contents of the present disclosure.

FIG. 1 is a block diagram of an exemplary apparatus for controlling and/or maintaining a banknote feed rate according to one or more embodiments of the present invention.

Referring to FIG. 1, the exemplary apparatus for controlling and/or maintaining a banknote feed rate includes a banknote sensing unit 111, a controller 120, a motor driver 130, and a motor 140.

The banknote sensing unit 111 includes one or more sensors in the banknote transfer path between a banknote feeder (not shown) and a decider (e.g., a denomination discriminator or sorter; not shown), and senses the start and end of banknote feeding, passing of a banknote, a transfer state of a banknote, an interval between banknotes, a banknote breadth (e.g., length or width), the skew of a banknote, and the like. Especially when the banknote sensing unit 111 includes a plurality of sensors, the sensors are preferably arranged in a row perpendicular to the banknote transfer direction.

The banknote sensing unit 111 may include, for example, optical sensors such as an infrared sensor and/or an ultraviolet sensor, or sensors operating in any other scheme (e.g., using terahertz radiation or electromagnetism [e.g., one or more magnets or capacitors]). For convenience, the following description is given with the appreciation that optical sensors are used in various embodiments of the present invention.

A banknote discriminator according to one or more embodiments picks up banknotes placed on the banknote feeder (not shown) one by one using a pick-up roller (not shown) and transfers each banknote along a predetermined internal path using a transfer roller (not shown). Conventionally, in order to maintain a constant feed rate of the banknotes (e.g., at a predetermined target feed rate), a revolution rate of the motor 140 (e.g., a feed motor or a transfer motor) is maintained at a predetermined target revolution rate, irrespective of the actual banknote feed rate.

Therefore, although the revolution rate of the motor 140 may be controlled by directly detecting the revolution rate of the motor 140 and/or applying a voltage or current corresponding to the target revolution rate to the motor 140 using an encoder (not shown), addition of the encoder and related peripheral electronic circuits and mechanical structures makes the structure of the banknote feeder of the banknote discriminator more complex, increases the cost and size of the banknote discriminator, and suppresses potential throughput increases in the conventional technology. Moreover, the encoder and its peripheral circuitry become another potential factor or cause of malfunction, trouble or failure. Since the actual banknote feed rate may not match the target revolution rate of the motor (e.g., due to slippage or delay of the banknotes along the internal path of the banknote discriminator) as described before, the method for maintaining a banknote feed rate by controlling the revolution rate of the motor using an encoder and its peripheral circuit may decrease efficiency.

In this context, embodiment(s) of the present invention provide a method for maintaining an actual banknote feed rate at a predetermined target feed rate by calculating the actual banknote feed rate based on an interval for introduced banknotes using a banknote sensing signal from (or generated by) the banknote sensing unit 111, and controlling a revolution rate of the motor 140 based on the calculated actual banknote feed rate, without using the above-described encoder and its peripheral circuits.

Figure 2:
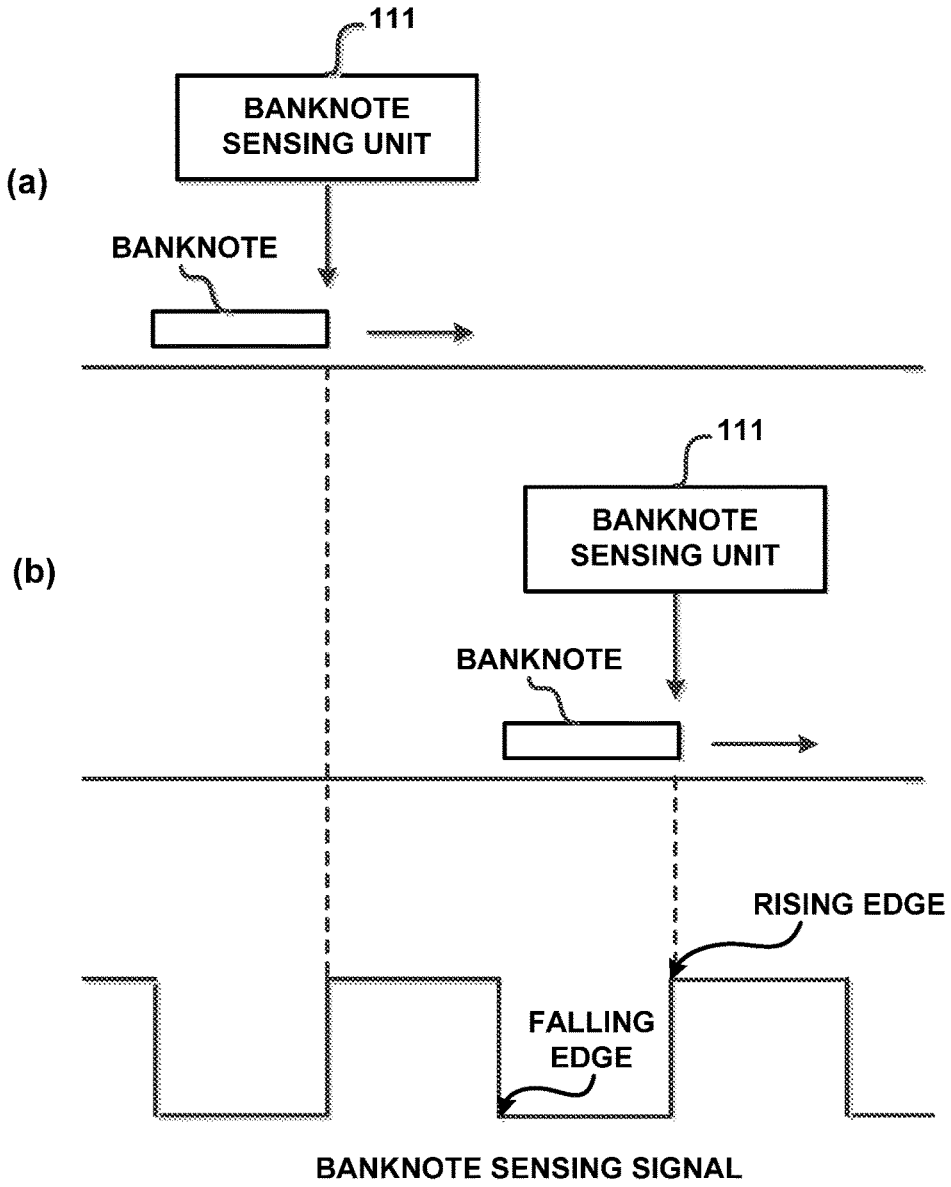
FIG. 2 is an exemplary diagram illustrating characteristics of a banknote sensing signal from the banknote sensing unit illustrated in FIG. 1.

FIG. 2 is an exemplary diagram illustrating characteristics of a banknote sensing signal detected by the banknote sensing unit illustrated in FIG. 1.

Referring to (a) of FIG. 2, upon sensing a leading edge of an introduced banknote (e.g., at the point in time at which the leading edge of the banknote is sensed in the transfer direction), the banknote sensing unit 111 transitions or changes the state of a banknote sensing signal (e.g., outputs a rising edge), and upon sensing a trailing edge of the introduced banknote (e.g., at the point in time at which the trailing edge of the banknote is sensed in the transfer direction), the banknote sensing unit 111 transitions or changes the state of the banknote sensing signal in the opposite direction (e.g., outputs a falling edge). The banknote sensing signal may also be output in a different manner or form, as may be determined or derived by those skilled in the art.

Referring to (b) in FIG. 2, in the same manner, upon sensing a leading edge of a following or subsequently introduced banknote, the banknote sensing unit 111 transitions or changes the state of the banknote sensing signal (e.g., outputs a second rising edge), and upon sensing a trailing edge time of the following banknote, the banknote sensing unit 111 transitions or changes the state of the banknote sensing signal in the opposite direction (e.g., outputs a second falling edge).

The controller 120 may measure a time interval between the first rising edge and the second rising edge, and calculate an interval (e.g., a banknote interval) between the leading edge of the first banknote and the leading edge of the following or subsequent banknote using the measured time interval and the predetermined, detected or measured revolution rate (e.g., 1,000 rpm) of the motor. An actual banknote feed rate may be calculated by comparing the calculated banknote interval with a banknote interval (e.g., 60 ms) corresponding to a normal or target banknote feed rate. If the actual banknote feed rate is lower or higher than the normal banknote feed rate, the actual banknote feed rate may be controlled or adjusted to (or to approach) the target feed rate by increasing or decreasing a motor rate, respectively. While it has been described that an actual banknote feed rate is calculated using a time interval between the leading edges of first and following or subsequent banknotes, this is purely exemplary. Thus, as far as an interval between introduced banknotes is calculated, any method is available, such as using a time interval between the trailing edges of preceding and following banknotes, using a gap between pulses, using a time interval between rising or falling transitions of a plurality of banknotes (e.g., 2, 3, 5, 10 or more banknotes), etc.

Figure 3:
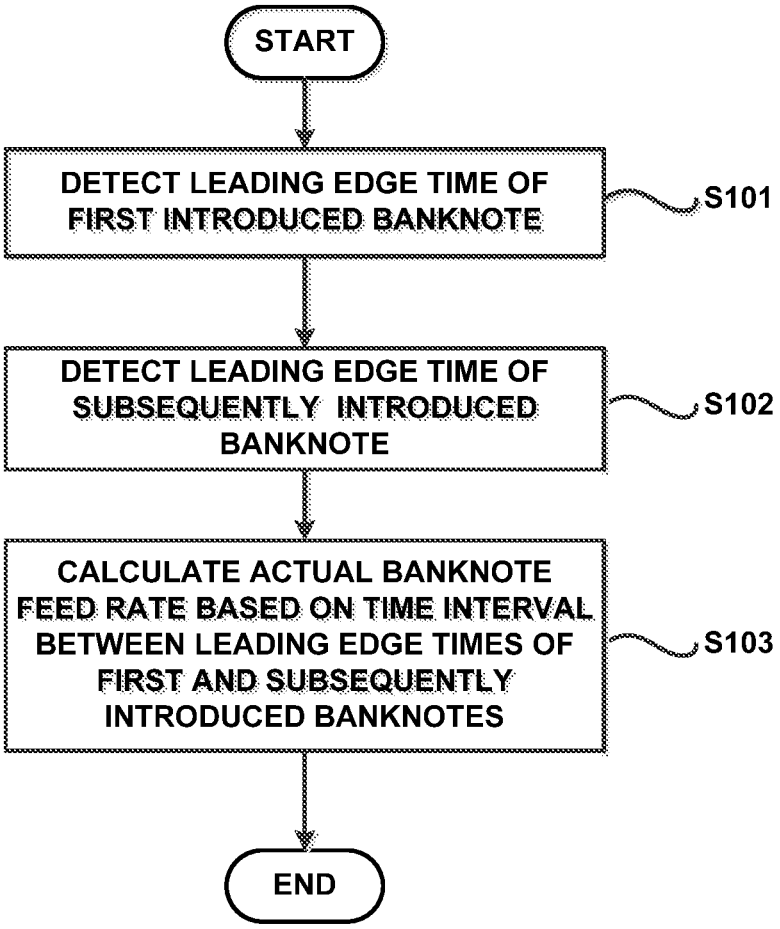
FIG. 3 is a flowchart illustrating an exemplary method for controlling and/or maintaining a banknote feed rate based on an actual interval between introduced banknotes using a banknote sensing signal detected by the banknote sensing unit illustrated in FIG. 1.

FIG. 3 is a flowchart illustrating a method for controlling and/or maintaining a banknote feed rate based on an actual banknote feed rate using a banknote sensing signal from the banknote sensing unit illustrated in FIG. 1.

Referring to FIG. 3, the controller 120 detects a leading edge time of a first or initial introduced banknote (e.g., a time at which the leading edge of the banknote is sensed by the banknote sensing unit 111) by analyzing the banknote sensing signal from the banknote sensing unit 111 (S101).

For example, the banknote sensing unit 111 may output a banknote sensing signal having a rising edge at the leading edge time of the first or initial introduced banknote and a falling edge at a trailing edge time of the first or initial introduced banknote. However, in some embodiments, the banknote sensing unit 111 may output a banknote sensing signal in a different manner or having a different form.

Subsequently, the controller 120 detects the leading edge time of a subsequently introduced banknote successive to the first or initial introduced banknote (e.g., a following banknote) by analyzing the banknote sensing signal from the banknote sensing unit 111 (S102).

For example, the banknote sensing signal output by the banknote sensing unit 111 may have a rising edge at the leading edge time of the subsequently introduced banknote and a falling edge at a trailing edge time of the subsequently introduced banknote. That is, the banknote sensing signal(s) may include information about the leading edge time of the first or initial introduced banknote and the leading edge time of the subsequently introduced banknote (e.g., a first rising edge and a second rising edge).

The controller 120 measures a time interval between the leading edge times of the first or initial and subsequently introduced banknotes (e.g., a time interval from the time of the first rising edge to the time of the second rising edge).

An interval between the leading edges of the first or initial and subsequently introduced banknotes (i.e., a banknote interval) increases or decreases according to the revolution rate of the motor 140 (e.g., as the motor revolution rate decreases, the banknote interval increases, and as the motor revolution rate increases, the banknote interval decreases).

Accordingly, the controller 120 calculates an actual banknote feed rate based on the time interval (e.g., banknote interval) between the leading edge times of the first or initial and subsequently introduced banknotes (S103).

For example, the controller 120 may calculate an actual banknote feed rate by comparing the measured banknote interval with a banknote interval corresponding to a normal, predetermined or target banknote feed rate (e.g., 60 ms). If the actual banknote feed rate is lower or higher than the normal, predetermined or target banknote feed rate, the controller 120 controls or adjusts the revolution rate of the motor 140 to match or approach the normal, predetermined or target feed rate by increasing or decreasing the revolution rate of the motor.

While it has been described that an actual banknote feed rate is calculated using a time interval between the leading edges of a first or initial introduced banknote and a subsequently introduced banknote, this is purely exemplary. Thus, as far as the interval between introduced banknotes is calculated, any method is available, such as using a time interval between the trailing edges of first or initial and subsequently introduced banknotes, or using a gap between pulses corresponding to the time during which the banknote sensing unit 111 senses the banknote.

In the foregoing embodiment, an actual banknote feed rate is calculated using a single banknote sensing unit (i.e., the banknote sensing unit 111).

Now, a description will be given of a method for calculating an actual banknote feed rate using a plurality of banknote sensing units (e.g., first and second banknote sensing units).

Figure 4:
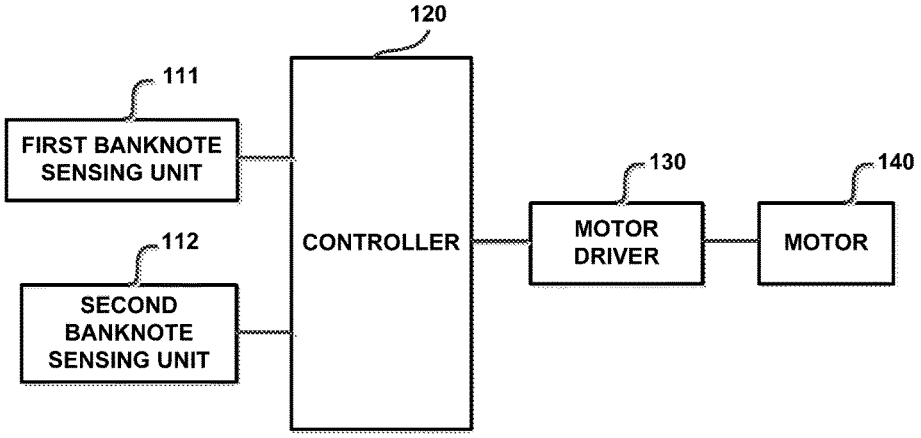
FIG. 4 is a block diagram of an exemplary apparatus for controlling and/or maintaining a banknote feed rate according to one or more other embodiments of the present invention.

FIG. 4 is a block diagram of an apparatus for controlling and/or maintaining a banknote feed rate according to one or more other embodiments of the present invention.

Referring to FIG. 4, the apparatus for controlling and/or maintaining a banknote feed rate according to the second embodiment of the present invention includes a first banknote sensing unit 111, a second banknote sensing unit 112, a controller 120, a motor driver 130, and a motor 140. Compared to the example illustrated in FIG. 1, the example of FIG. 4 further includes the second banknote sensing unit 112.

Figure 5:
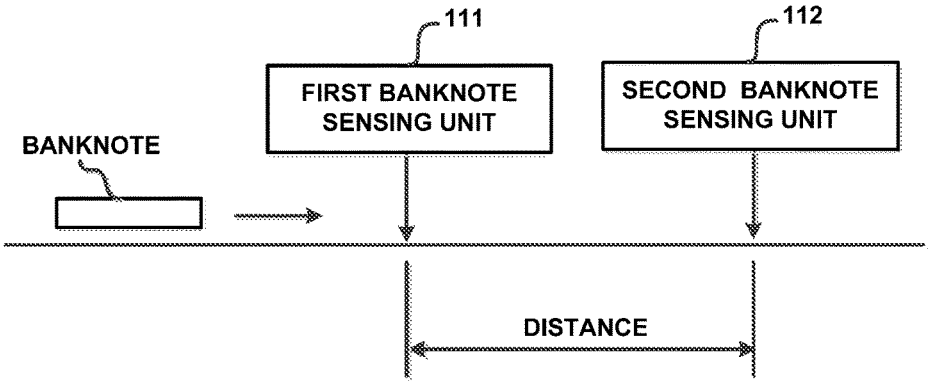
FIG. 5 is an exemplary diagram illustrating an arrangement of the first banknote sensing unit and the second banknote sensing unit in FIG. 4, spaced apart from each other by a predetermined distance.

As is shown in FIG. 5, the first and second banknote sensing units 111 and 112 are placed apart from each other by a predetermined gap (e.g., distance). Each of the first and second banknote sensing units 111 and 112 includes one or more sensors (which may be arranged in a row perpendicular to the banknote transfer direction) in the banknote transfer path between the banknote feeder (not shown) and a decider (e.g., a denomination discriminator or sorter; not shown). The first and second banknote sensing units 111 and 112 successively sense the start and end of banknote feeding, the passing of a banknote, a transfer state of a banknote, an interval between successive banknotes, a banknote breadth (e.g., length or width), the skew of a banknote, and the like. A difference (e.g., a time difference) is generated between the times and/or points at which the first and second banknote sensing units 111 and 112 sense the banknote, and the banknote feed rate is determined from the difference and the distance between the first and second banknote sensing units 111 and 112 (see FIG. 6).

It is assumed that the distance (e.g., the gap between the first and second banknote sensing units 111 and 112) and/or other information about the distance is known.

Figure 6:
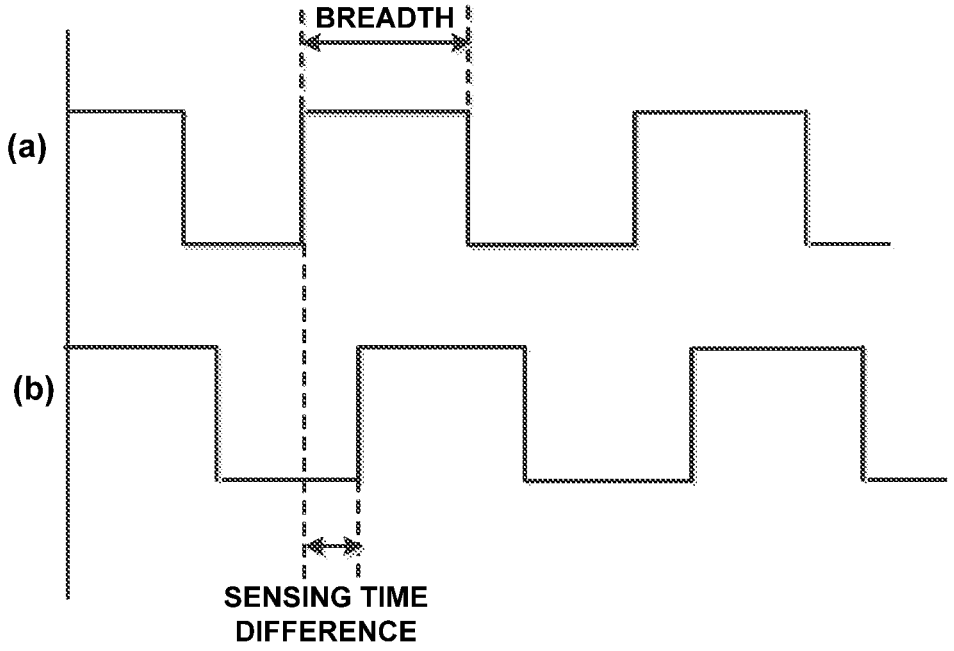
FIG. 6 is an exemplary diagram illustrating characteristics of banknote sensing signals from the first and second banknote sensing units illustrated in FIG. 4.

FIG. 6 is an exemplary diagram illustrating characteristics of banknote sensing signals detected by the first and second banknote sensors illustrated in FIG. 4.

Referring to FIG. 6, a time difference (e.g., a difference between sensing time and/or points) can be determined from a detection (or sensing) signal of each introduced banknote in correspondence with the distance between the first and second banknote sensing units 111 and 112.

For example, on the assumption that waveform (a) in FIG. 6 illustrates a banknote sensing signal detected by the first banknote sensing unit 111 and waveform (b) in FIG. 6 illustrates a banknote sensing signal detected by the second banknote sensing unit 112, a sensing time difference (e.g., a banknote sensing time difference) occurs in correspondence with the distance between the first and second banknote sensing units 111 and 112.

In the example of FIG. 6, the length of time that the banknote sensing signal is at high level (e.g., a binary logic high state, or a binary "1") corresponds to a banknote breadth, width or length, and the length of time that the banknote sensing signal is at low level (e.g., a binary logic low state, or a binary "0") corresponds to the interval between a first or initial banknote and a subsequent or successive banknote.

Therefore, the controller 120 may calculate an actual banknote feed rate by dividing the known distance between the first and second banknote sensing units 111 and 112 (or information about the known distance) by the difference between sensing times or points (e.g., the difference between banknote sensing times) of the first and second banknote sensing signals (or information about the difference) illustrated respectively in waveforms (a) and (b) of FIG. 6. While a sensing period of each banknote corresponding to a high level of each of the first and second banknote sensing signals has been described (see FIG. 6), in other embodiments, the banknote sensing period may be configured as a low level of the banknote sensing signal, or a period between successive transitions in the same direction (e.g., successive rising edges or successive falling edges).

Figure 7:
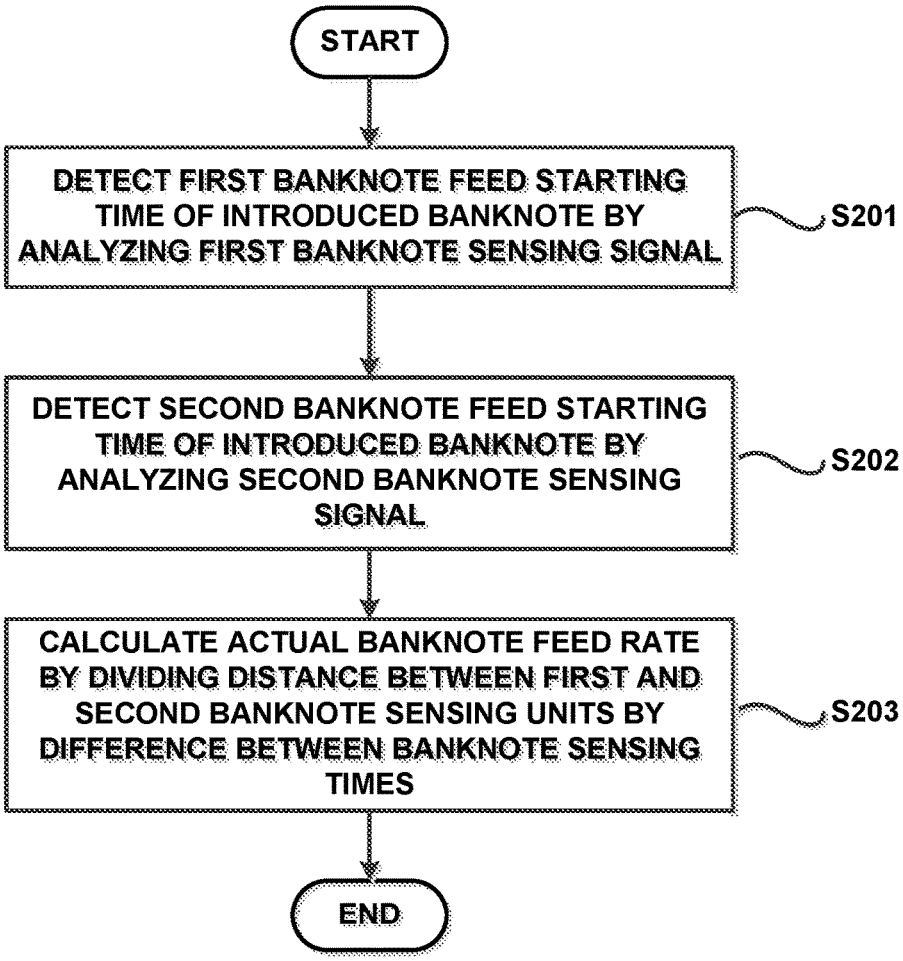
FIG. 7 is a flowchart illustrating an exemplary method for calculating a banknote feed rate using the banknote sensing signals from the first and second banknote sensing units illustrated in FIG. 4.

FIG. 7 is a flowchart illustrating a method for calculating a banknote feed rate using banknote sensing signals detected by the first and second banknote sensing units (111, 112) illustrated in FIG. 4.

Referring to FIG. 7, a first banknote feed starting time (or leading edge time) of an introduced banknote is detected (e.g., by a controller) by analyzing a first banknote sensing signal (e.g., from a first banknote sensing unit) at S201.

For example, the first banknote sensing unit 111 may output a first banknote sensing signal having a rising edge or transition at the banknote feed starting time. However, in some embodiments, the first banknote sensing signal may indicate the banknote feed starting time in a different form.

Subsequently, a second banknote feed starting time (or leading edge time) of the introduced banknote is detected (e.g., by the controller) by analyzing a second banknote sensing signal (e.g., from a second banknote sensing unit) at S202.

For example, the second banknote sensing unit 112 may output a second banknote sensing signal having a rising edge or transition at the starting time of the banknote being sensed by the second banknote sensing unit 112. However, in some embodiments, the second banknote sensing signal may indicate the second banknote feed starting time in a different form.

The distance between the first and second banknote sensing units is known by design. Therefore, the controller calculates an actual banknote feed rate by dividing the known distance between the first and second banknote sensing units 111 and 112 (or information about the known distance) by the difference between sensing times (e.g., the difference between banknote sensing times) in the first and second banknote sensing signals respectively illustrated in (a) and (b) of FIG. 6 (e.g., the second banknote feed starting time—the first banknote feed starting time) or information about the difference in S203.

Figure 8:
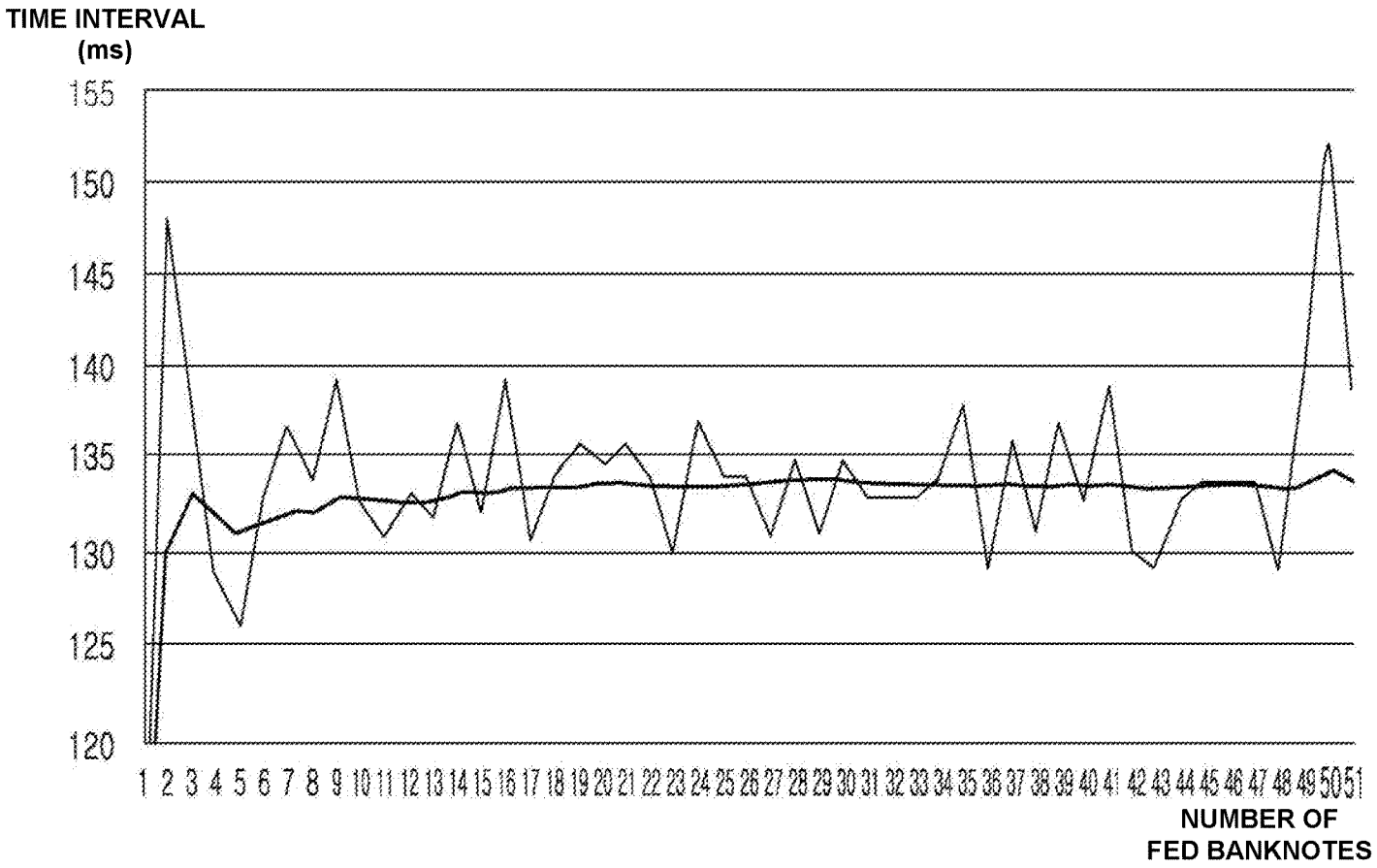
FIG. 8 is an exemplary diagram showing or describing a reason for calculating an average banknote feed rate using the banknote sensing signals from the first and second banknote sensing units illustrated in FIGS. 1 and 4.

Although the actual banknote feed rate may be calculated using two banknote sensing units (e.g., the first and second banknote sensing units 111 and 112), the actual banknote feed rate may vary at each measurement according to the state of the introduced banknote, the feeding scheme or technique for the banknote, the state of a roller in the internal pathway of the banknote discriminator, and the like. For example, FIG. 8 shows the variability of the actual banknote feed rate of a banknote discriminator from banknote to banknote for 50 successively fed banknotes.

Figure 9:
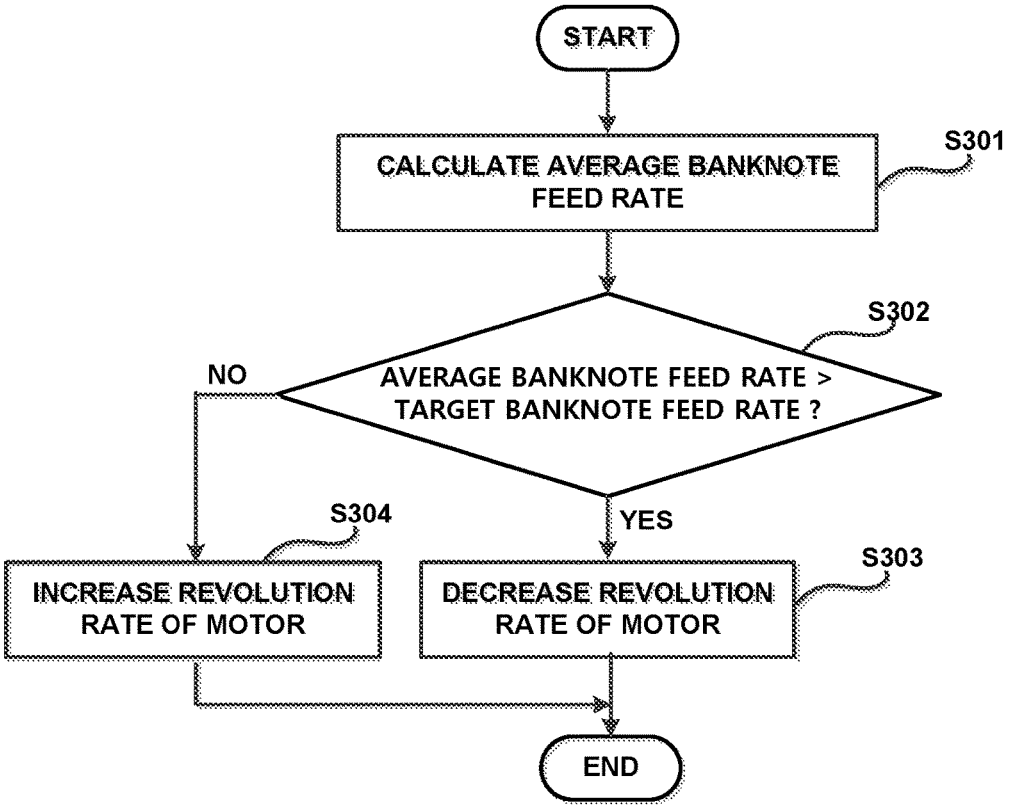
FIG. 9 is a flowchart illustrating an exemplary method for controlling and/or maintaining a banknote feed rate according to the present invention.

Therefore, the controller 120 may calculate the average banknote feed rate (e.g., the average of the feed rates of a predetermined number of banknotes) calculated using banknote sensing signals detected by the first banknote sensing unit 111 illustrated in FIG. 1 or the first and second banknote sensing units 111 and 112 illustrated in FIG. 4, and control or adjust the revolution rate of the motor 140 based on the calculated average banknote feed rate (see FIG. 9).

That is, if the revolution rate of the motor 140 is controlled according to a fine change in a banknote feed rate at each measurement, stability is decreased. Accordingly, the controller 120 according to one or more embodiments controls the revolution rate of the motor 140 based on the average banknote feed rate detected by the first banknote sensing unit 111 or both of the first and second banknote sensing units 111 and 112, to thereby increase stability.

For reference, the controller 120 may calculate the average banknote feed rate directly or the using a separate digital filter. Furthermore, the predetermined number of actual banknote feed rates for which the average is calculated can any plural integer (e.g., 2, 3, 5, 10, etc.), and the plural integer can be fixed or cumulative (and if cumulative, it can be reset periodically or upon each use of the banknote discriminator). The average banknote feed rate may also be running (e.g., updated with each banknote for which a banknote feed rate is determined or measured) or fixed (e.g., for a predetermined number of banknotes, such as 10, 50, 100 or more, or for a predetermined period of time, such as a minute, an hour, a day, etc.).

Once the average banknote feed rate is calculated, the controller 120 compares the average banknote feed rate with a predetermined target feed rate.

If the average banknote feed rate is higher than the predetermined target feed rate, the controller 120 decreases the revolution rate of the motor 140 through the motor driver 130. On the contrary, if the average banknote feed rate is lower than (or equal to or lower than) the predetermined target feed rate, the controller 120 increases the revolution rate of the motor 140 through the motor driver 130.

As described above, an actual banknote feed rate is detected or measured, and the revolution rate of the motor 140 is controlled according to the actual banknote feed rate or an average banknote feed rate, rather than the revolution rate of the motor 140 being directly detected and the motor being controlled according to a target revolution rate. Thus, the potential problems encountered with banknote feed rate control systems where the revolution rate of a motor is detected directly using an encoder (not shown) and controlled according to a target revolution rate (e.g., the encoder, its mechanical structure, and/or its associated peripheral circuits can malfunction, and these components necessarily increase the volume and weight of the banknote feeding unit of the banknote discriminator) may be overcome. Further, as the encoder, the mechanical structure, and the peripheral circuits are not needed, cost efficiency may increase.

FIG. 8 is an exemplary diagram for describing a reason for calculating the average banknote feed rate calculated using banknote sensing signals from the first banknote sensing unit in FIG. 1 and/or the first and second banknote sensing units in FIG. 4.

As described before, even though banknotes of the same kind are fed at a constant revolution rate of the motor 140, an actual banknote feed rate (or the breadth, length or width of one pulse of a banknote sensing signal) may differ slightly at each measurement, as illustrated in FIG. 8.

If the revolution rate of the motor 140 is increased or decreased in response to a small change in the banknote feed rate at each measurement, the operation stability of the banknote discriminator may decrease (e.g., as a result of wear-and-tear on the motor and/or motor driver, which may change the motor rotation speed frequently). Therefore, the controller 120 may calculate the average banknote feed rate and control the revolution rate of the motor 140 according to the calculated average banknote feed rate. Consequently, the banknote feed rate and the banknote feed equipment of the banknote discriminator may be maintained stably.

FIG. 9 is a flowchart illustrating a method for controlling and/or maintaining a banknote feed rate according to the present invention.

In FIG. 9, it is assumed that banknote feed rates have been calculated according to at least one of the methods described with reference to FIG. 1 or FIG. 4.

Thus, the banknote feed rates may be calculated using a banknote sensing signal output from a single banknote sensing unit, or using first and second banknote sensing signals output from first and second banknote sensing units. Thereafter, a controller 120 calculates the average of the banknote feed rates (e.g., an average banknote feed rate) is calculated (e.g., by a controller) at S301.

After calculating the average of the banknote feed rates (e.g., the average banknote feed rate), the average banknote feed rate is compared with a predetermined target feed rate (e.g., by the controller) at S302.

If the average banknote feed rate is higher than the predetermined target feed rate (Yes in S302), the revolution rate of a motor transferring or feeding the banknote through the banknote discriminator is decreased (e.g., by the controller, through a motor driver) at S303.

On the contrary, if the average banknote feed rate is lower than (or equal to or lower than) the predetermined target feed rate (No in S302), the revolution rate of the motor is increased (e.g., by the controller, through the motor driver) at S304.

For reference, increments/decrements for the revolution rate of the motor (or voltage/current values corresponding to the revolution rate increments/decrements) mapped to differences between the average banknote feed rate and the predetermined target feed rate may be pre-stored in a look-up table in an internal memory (not shown).

In the present invention, an actual banknote feed rate is measured and a revolution rate of a motor is controlled based on the actual banknote feed rate, so that the banknote feed rate may be maintained at a predetermined target feed rate. Herein, since the actual banknote feed rate is measured using at least one banknote sensor at or near a banknote feeder and/or the front end of a decider such as a denomination discriminator or a sorter (or in the transfer path between the banknote feeder and the decider), rather than directly detecting the revolution rate of the motor, a sensor related to detection of the revolution rate of the motor and its related mechanical structures and electronic circuits are not needed, thereby simplifying the structure of the banknote discriminator, decreasing the volume and weight of the banknote discriminator, and reducing the fabrication cost of the banknote discriminator.

As is apparent from the foregoing description of the present invention, the banknote feed rate of a banknote discriminator can be maintained at a predetermined target feed rate based on an interval between successively transferred banknotes. Further, the revolution rate of a feed motor is controlled by measuring an actual banknote feed rate, thereby controlling and/or maintaining the banknote feed rate at the predetermined target feed rate.

In addition, since the actual banknote feed rate as calculated herein reflects phenomena such as slippage or delay of the banknote under motor control using a banknote sensor between the banknote feeder and the decider (e.g., a denomination discriminator or sorter), rather than directly detecting the revolution rate of the motor, sensors related to detection of the revolution rate of the motor and related mechanical structures and electronic circuits are not needed, thereby simplifying the constitutional structure of the banknote discriminator, reducing its cost, and potentially increasing throughput.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for controlling and/or maintaining a banknote feed rate, comprising:

a motor configured to generate a driving force to feed or transfer a banknote;

a banknote sensing unit configured to detect the fed or transferred banknote; and a controller configured to (i) calculate a feed rate of the fed or transferred banknotes by analyzing a banknote sensing signal from the banknote sensing unit, (ii) compare the calculated feed rate with a predetermined target banknote feed rate, and, when the calculated feed rate is lower or higher than the predetermined target banknote feed rate, (iii) increase or decrease a revolution rate of the motor such that the calculated feed rate is maintained at or approaches the predetermined target banknote feed rate.

2. The apparatus according to claim 1, wherein the banknote sensing unit includes at least one optical sensor.

3. The apparatus according to claim 1, wherein the controller calculates the feed rate using a time interval between a feeding time of a first banknote and a feeding time of a second banknote from the banknote sensing unit.

4. The apparatus according to claim 1, wherein the banknote sensing unit comprises first and second banknote sensing units apart from each other by a specific distance, the first banknote sensing unit detects a first sensing time, the second banknote sensing unit detects a second sensing time, and the controller calculates the feed rate by dividing information about the specific distance between the first and second banknote sensing units by information about a difference between the first sensing time and the second sensing time.

5. The apparatus according to claim 1, wherein the controller calculates an average calculated banknote feed rate, and controls the revolution rate of the motor such that the average banknote feed rate equals the predetermined target feed rate.

6. The apparatus according to claim 5, further comprising a memory configured to pre-store motor revolution rate increments and decrements corresponding to differences between the average banknote feed rate and the predetermined target feed rate.

7. The apparatus according to claim 5, further comprising a memory configured to pre-store voltage or current values corresponding to motor revolution rate increments and decrements corresponding to differences between the average banknote feed rate and the predetermined target feed rate.

8. The apparatus according to claim 1, wherein the controller is further configured to (iv) measure a time interval between a feeding time of a first banknote and a feeding time of a second banknote using the banknote sensing signal, (v) calculate a banknote interval using the measured time interval and a predetermined revolution rate of the motor, and (vi) calculate the banknote feed rate by comparing the calculated banknote interval with a target banknote interval corresponding to the predetermined target banknote feed rate.

9. The apparatus according to claim 1, further comprising a banknote feeder, a denomination discriminator or sorter, and a banknote transfer path between the banknote feeder and the denomination discriminator or sorter configured to transfer the banknote from the banknote feeder to the denomination discriminator or sorter, wherein the banknote transfer path comprises one or more rollers rotated by the motor.

10. A method for controlling and/or maintaining a banknote feed rate, comprising:

detecting a fed or transferred banknote using a banknote sensing unit;

calculating a feed rate of the fed or transferred banknote by analyzing a banknote sensing signal from the banknote sensing unit using a controller; and using the controller, controlling a revolution rate of a driving motor configured to generate a driving force to feed or transfer subsequently fed or transferred banknotes at or approaching the calculated feed rate by comparing the calculated feed rate with a predetermined target banknote feed rate, and when the calculated feed rate is lower or higher than the predetermined target banknote feed rate, increasing or decreasing the revolution rate of the motor.

11. The method according to claim 10, further comprising detecting a feeding time of a first banknote and a feeding time of a second banknote using the banknote sensing unit, and the feed rate is calculated by the controller using a time interval between the feeding time of the first banknote and the feeding time of the second banknote.

12. The method according to claim 10, wherein the banknote sensing unit comprises first and second banknote sensing units apart from each other by a specific distance, the method further comprises detecting a first sensing time using the first banknote sensing unit and detecting a second sensing time using the second banknote sensing unit, and the feed rate is calculated by dividing information about the distance between the first and second banknote sensing units by information about a difference between the first sensing time and the second sensing time.

13. The method according to claim 10, wherein controlling the revolution rate of the driving motor comprises:

calculating an average banknote feed rate using the controller; and controlling the revolution rate of the driving motor such that the average banknote feed rate equals the predetermined target feed rate.

14. The method according to claim 10, further comprising:

measuring a time interval between a feeding time of a first banknote and a feeding time of a second banknote using the banknote sensing signal, and calculating a banknote interval using the measured time interval and a predetermined revolution rate of the motor, wherein calculating the banknote feed rate comprises comparing the calculated banknote interval with a target banknote interval corresponding to the predetermined target banknote feed rate.

15. An apparatus for controlling and/or maintaining a banknote feed rate, comprising:

a motor configured to generate a driving force to feed or transfer a banknote;

a banknote sensing unit configured to detect fed or transferred banknotes, comprising first and second banknote sensing units apart from each other by a specific distance, wherein the first banknote sensing unit detects a first sensing time, and the second banknote sensing unit detects a second sensing time; and a controller configured to (i) calculate a feed rate of the fed or transferred banknotes by analyzing a banknote sensing signal from the banknote sensing unit, and dividing information about the specific distance between the first and second banknote sensing units by information about a difference between the first sensing time and the second sensing time, and (ii) control the motor based on the calculated feed rate.

16. The apparatus according to claim 15, wherein the banknote sensing unit includes at least one optical sensor.

17. The apparatus according to claim 15, wherein the controller calculates the feed rate using a time interval between a feeding time of a first banknote and a feeding time of a second banknote from the banknote sensing unit.

18. An apparatus for controlling and/or maintaining a banknote feed rate, comprising:

a motor configured to generate a driving force to feed or transfer a banknote;

a banknote sensing unit configured to detect fed or transferred banknotes; and a controller configured to (i) calculate a feed rate of the fed or transferred banknotes by analyzing a banknote sensing signal from the banknote sensing unit, (ii) calculate an average banknote feed rate, and (iii) control a revolution rate of the motor such that the average banknote feed rate equals a predetermined target feed rate.

19. The apparatus according to claim 18, further comprising a memory configured to pre-store motor revolution rate increments and decrements corresponding to differences between the average banknote feed rate and the predetermined target feed rate.

20. The apparatus according to claim 18, further comprising a memory configured to pre-store voltage or current values corresponding to motor revolution rate increments and decrements corresponding to differences between the average banknote feed rate and the predetermined target feed rate.

* * * * *